US006922253B2

(12) United States Patent
Moore

(10) Patent No.: US 6,922,253 B2
(45) Date of Patent: Jul. 26, 2005

(54) PLANARIZING MACHINES AND CONTROL SYSTEMS FOR MECHANICAL AND/OR CHEMICAL-MECHANICAL PLANARIZATION OF MICROELECTRONIC SUBSTRATES

(75) Inventor: Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/620,713

(22) Filed: Jul. 15, 2003

(65) Prior Publication Data

US 2004/0012795 A1 Jan. 22, 2004

Related U.S. Application Data

(62) Division of application No. 09/651,240, filed on Aug. 30, 2000, now Pat. No. 6,609,947.

(51) Int. Cl.[7] ..... G01B 11/06
(52) U.S. Cl. ..... 356/630
(58) Field of Search ..... 356/630, 632

(56) References Cited

U.S. PATENT DOCUMENTS

| | | | | |
|---|---|---|---|---|
| 4,145,703 A | * | 3/1979 | Blanchard et al. | 257/331 |
| 4,200,395 A | | 4/1980 | Smith et al. | |
| 4,203,799 A | | 5/1980 | Sugawara et al. | |
| 4,305,760 A | * | 12/1981 | Trudel | 438/16 |
| 4,358,338 A | | 11/1982 | Downey et al. | |
| 4,367,044 A | | 1/1983 | Booth, Jr. et al. | |
| 4,377,028 A | | 3/1983 | Imahashi | |
| 4,422,764 A | | 12/1983 | Eastman | |
| 4,498,345 A | | 2/1985 | Dyer et al. | |
| 4,501,258 A | | 2/1985 | Dyer et al. | |
| 4,502,459 A | | 3/1985 | Dyer | |

(Continued)

FOREIGN PATENT DOCUMENTS

| | | |
|---|---|---|
| EP | 0 623 423 A1 | 11/1994 |
| WO | WO 99/56078 A1 | 11/1999 |

OTHER PUBLICATIONS

Applied Materials, Inc., "Mirra Mesa Advanced Integrated CMP," 2 pages, 2002, retrieved from the Internet, <http://www.appliedmaterials.com>.

Applied Materials, Inc., "About the CMP Process," 1 page, 2002, retrieved from the Internet, <http://www.appliedmaterials.com>.

U.S. Appl. No. 10/624,382, filed Jul. 21, 2003, Agarwal.

*Primary Examiner*—Richard A. Rosenberger
(74) *Attorney, Agent, or Firm*—Perkins Coie LLP

(57) ABSTRACT

A system for controlling a mechanical or chemical-mechanical planarizing machine comprises a light system, a sensor, and a computer. The light system can have at least a first emitter that generates a first light pulse having a first color and a second emitter that generates a second light pulse having a second color different than the first color. The first and second light pulses reflect from a microelectronic substrate in a manner that creates a first return light pulse corresponding to a reflectance of the first light pulse and a second return light pulse corresponding to a reflectance of the second light pulse. The sensor receives the first return light pulse and the second return light pulse, and the sensor generates a first measured intensity of the first return light pulse and a second measured intensity of the second return light pulse. The computer has a database and a computer readable medium. The database contains a plurality of sets of reference reflectances in which each set has a first reference component defined by a reflectance intensity of the first light pulse and a second reference component defined by a reflectance intensity of the second light pulse from a selected surface level in a layer of material on the microelectronic substrate. The computer readable medium contain a computer readable program that causes the computer to control a parameter of the planarizing machine when the first and second measured intensities correspond to the first and second reference components of a selected reference reflectance set.

20 Claims, 9 Drawing Sheets

U.S. PATENT DOCUMENTS

| | | | | |
|---|---|---|---|---|
| 4,640,002 | A | | 2/1987 | Phillips et al. |
| 4,660,980 | A | | 4/1987 | Takabayashi et al. |
| 4,717,255 | A | | 1/1988 | Ulbers |
| 4,755,058 | A | * | 7/1988 | Shaffer ..... 356/446 |
| 4,879,258 | A | | 11/1989 | Fisher |
| 4,946,550 | A | * | 8/1990 | Van Laarhoven ..... 438/631 |
| 4,971,021 | A | | 11/1990 | Kubotera et al. |
| 5,020,283 | A | | 6/1991 | Tuttle |
| 5,036,015 | A | | 7/1991 | Sandhu et al. |
| 5,069,002 | A | | 12/1991 | Sandhu et al. |
| 5,081,796 | A | | 1/1992 | Schultz |
| 5,163,334 | A | | 11/1992 | Li et al. |
| 5,196,353 | A | | 3/1993 | Sandhu et al. |
| 5,220,405 | A | | 6/1993 | Barbee et al. |
| 5,222,329 | A | | 6/1993 | Yu |
| 5,232,875 | A | | 8/1993 | Tuttle et al. |
| 5,240,552 | A | | 8/1993 | Yu et al. |
| 5,244,534 | A | | 9/1993 | Yu et al. |
| RE34,425 | E | | 11/1993 | Schultz |
| 5,314,843 | A | | 5/1994 | Yu et al. |
| 5,324,381 | A | | 6/1994 | Nishiguchi |
| 5,369,488 | A | | 11/1994 | Morokuma |
| 5,393,624 | A | | 2/1995 | Ushijima |
| 5,413,941 | A | | 5/1995 | Koos et al. |
| 5,433,649 | A | | 7/1995 | Nishida |
| 5,433,651 | A | * | 7/1995 | Lustig et al. ..... 451/6 |
| 5,439,551 | A | | 8/1995 | Meikle et al. |
| 5,449,314 | A | | 9/1995 | Meikle et al. |
| 5,461,007 | A | | 10/1995 | Kobayashi |
| 5,465,154 | A | | 11/1995 | Levy |
| 5,486,129 | A | | 1/1996 | Sandhu et al. |
| 5,514,245 | A | | 5/1996 | Doan et al. |
| 5,540,810 | A | | 7/1996 | Sandhu et al. |
| 5,573,442 | A | | 11/1996 | Morita et al. |
| 5,609,718 | A | | 3/1997 | Meikle |
| 5,616,069 | A | | 4/1997 | Walker et al. |
| 5,618,381 | A | | 4/1997 | Doan et al. |
| 5,618,447 | A | | 4/1997 | Sandhu |
| 5,624,303 | A | | 4/1997 | Robinson |
| 5,632,666 | A | | 5/1997 | Peratello et al. |
| 5,643,044 | A | | 7/1997 | Lund |
| 5,643,048 | A | | 7/1997 | Iyer |
| 5,645,471 | A | | 7/1997 | Strecker |
| 5,645,682 | A | | 7/1997 | Skrovan |
| 5,650,619 | A | | 7/1997 | Hudson |
| 5,655,951 | A | | 8/1997 | Meikle et al. |
| 5,658,183 | A | | 8/1997 | Sandhu et al. |
| 5,658,190 | A | | 8/1997 | Wright et al. |
| 5,663,797 | A | | 9/1997 | Sandhu |
| 5,667,424 | A | | 9/1997 | Pan |
| 5,668,061 | A | | 9/1997 | Herko et al. |
| 5,679,065 | A | | 10/1997 | Henderson |
| 5,681,204 | A | | 10/1997 | Kawaguchi et al. |
| 5,681,423 | A | | 10/1997 | Sandhu et al. |
| 5,690,540 | A | | 11/1997 | Elliott et al. |
| 5,698,455 | A | | 12/1997 | Meikle et al. |
| 5,700,180 | A | | 12/1997 | Sandhu et al. |
| 5,702,292 | A | | 12/1997 | Brunelli et al. |
| 5,725,417 | A | | 3/1998 | Robinson |
| 5,730,642 | A | | 3/1998 | Sandhu et al. |
| 5,736,427 | A | | 4/1998 | Henderson |
| 5,738,562 | A | | 4/1998 | Doan et al. |
| 5,738,567 | A | | 4/1998 | Manzonie et al. |
| 5,747,386 | A | | 5/1998 | Moore |
| 5,777,739 | A | | 7/1998 | Sandhu et al. |
| 5,779,522 | A | | 7/1998 | Walker et al. |
| 5,782,675 | A | | 7/1998 | Southwick |
| 5,791,969 | A | | 8/1998 | Lund |
| 5,792,709 | A | | 8/1998 | Robinson et al. |
| 5,795,218 | A | | 8/1998 | Doan et al. |
| 5,795,495 | A | | 8/1998 | Meikle |
| 5,798,302 | A | | 8/1998 | Hudson et al. |
| 5,801,066 | A | | 9/1998 | Meikle |
| 5,823,855 | A | | 10/1998 | Robinson |
| 5,830,806 | A | | 11/1998 | Hudson et al. |
| 5,842,909 | A | | 12/1998 | Sandhu et al. |
| 5,851,135 | A | | 12/1998 | Sandhu et al. |
| 5,855,804 | A | | 1/1999 | Walker |
| 5,865,665 | A | | 2/1999 | Yueh |
| 5,868,896 | A | | 2/1999 | Robinson et al. |
| 5,871,392 | A | | 2/1999 | Meikle et al. |
| 5,879,222 | A | | 3/1999 | Robinson |
| 5,879,226 | A | | 3/1999 | Robinson |
| 5,882,248 | A | | 3/1999 | Wright et al. |
| 5,893,754 | A | | 4/1999 | Robinson et al. |
| 5,893,796 | A | | 4/1999 | Birang et al. |
| 5,894,852 | A | | 4/1999 | Gonzales et al. |
| 5,899,792 | A | | 5/1999 | Yagi |
| 5,910,043 | A | | 6/1999 | Manzonie et al. |
| 5,910,846 | A | | 6/1999 | Sandhu |
| 5,930,699 | A | | 7/1999 | Bhatia |
| 5,934,973 | A | | 8/1999 | Boucher et al. |
| 5,934,974 | A | | 8/1999 | Tzeng |
| 5,934,980 | A | | 8/1999 | Koos et al. |
| 5,936,733 | A | | 8/1999 | Sandhu et al. |
| 5,938,801 | A | | 8/1999 | Robinson |
| 5,949,927 | A | | 9/1999 | Tang |
| 5,954,912 | A | | 9/1999 | Moore |
| 5,972,792 | A | | 10/1999 | Hudson |
| 5,976,000 | A | | 11/1999 | Hudson |
| 5,980,363 | A | | 11/1999 | Meikle et al. |
| 5,981,396 | A | | 11/1999 | Robinson et al. |
| 5,989,470 | A | | 11/1999 | Doan et al. |
| 5,994,224 | A | | 11/1999 | Sandhu et al. |
| 5,997,384 | A | | 12/1999 | Blalock |
| 6,000,996 | A | | 12/1999 | Fujiwara |
| 6,006,739 | A | | 12/1999 | Akram et al. |
| 6,007,408 | A | | 12/1999 | Sandhu |
| 6,036,586 | A | | 3/2000 | Ward |
| 6,039,633 | A | | 3/2000 | Chopra |
| 6,040,111 | A | | 3/2000 | Karasawa et al. |
| 6,045,439 | A | | 4/2000 | Birang et al. |
| 6,046,111 | A | | 4/2000 | Robinson |
| 6,054,015 | A | | 4/2000 | Brunelli et al. |
| 6,057,602 | A | | 5/2000 | Hudson et al. |
| 6,068,539 | A | | 5/2000 | Bajaj et al. |
| 6,075,606 | A | | 6/2000 | Doan |
| 6,083,085 | A | | 7/2000 | Lankford |
| 6,102,775 | A | | 8/2000 | Ushio et al. |
| 6,106,351 | A | | 8/2000 | Raina et al. |
| 6,106,662 | A | | 8/2000 | Bibby, Jr. et al. |
| 6,108,091 | A | | 8/2000 | Pecen et al. |
| 6,108,092 | A | | 8/2000 | Sandhu |
| 6,110,820 | A | | 8/2000 | Sandhu et al. |
| 6,114,706 | A | | 9/2000 | Meikle et al. |
| 6,120,354 | A | | 9/2000 | Koos et al. |
| 6,124,207 | A | | 9/2000 | Robinson et al. |
| 6,139,402 | A | | 10/2000 | Moore |
| 6,143,123 | A | | 11/2000 | Robinson et al. |
| 6,146,248 | A | | 11/2000 | Jairath et al. |
| 6,152,803 | A | | 11/2000 | Boucher et al. |
| 6,179,709 | B1 | | 1/2001 | Redeker et al. |
| 6,184,571 | B1 | | 2/2001 | Moore |
| 6,186,870 | B1 | | 2/2001 | Wright et al. |
| 6,187,681 | B1 | | 2/2001 | Moore |
| 6,190,234 | B1 | | 2/2001 | Swedek et al. |
| 6,190,494 | B1 | | 2/2001 | Dow |
| 6,191,037 | B1 | | 2/2001 | Robinson et al. |
| 6,191,864 | B1 | | 2/2001 | Sandhu |
| 6,200,901 | B1 | | 3/2001 | Hudson et al. |
| 6,203,407 | B1 | | 3/2001 | Robinson |

6,203,413 B1 3/2001 Skrovan
6,206,754 B1 3/2001 Moore
6,206,759 B1 3/2001 Agarwal et al.
6,206,769 B1 3/2001 Walker
6,208,425 B1 3/2001 Sandhu et al.
6,210,257 B1 4/2001 Carlson
6,213,845 B1 4/2001 Elledge
6,224,466 B1 5/2001 Walker et al.
6,227,955 B1 5/2001 Custer et al.
6,234,877 B1 5/2001 Koos et al.
6,234,878 B1 5/2001 Moore
6,238,270 B1 5/2001 Robinson
6,238,273 B1 5/2001 Southwick
6,241,593 B1 6/2001 Chen et al.
6,244,944 B1 6/2001 Elledge
6,247,998 B1 6/2001 Wiswesser et al.
6,250,994 B1 6/2001 Chopra et al.
6,254,459 B1 7/2001 Bajaj et al.
6,261,151 B1 7/2001 Sandhu et al.
6,261,163 B1 7/2001 Walker et al.
6,264,533 B1 7/2001 Kummeth et al.
6,271,139 B1 8/2001 Alwan et al.
6,273,101 B1 8/2001 Gonzales et al.
6,273,800 B1 8/2001 Walker et al.
6,284,660 B1 9/2001 Doan
6,287,879 B1 9/2001 Gonzales et al.
6,290,572 B1 9/2001 Hofmann
6,296,557 B1 10/2001 Walker
6,301,006 B1 10/2001 Doan
6,306,008 B1 10/2001 Moore
6,306,014 B1 10/2001 Walker et al.
6,309,282 B1 10/2001 Wright et al.
6,312,558 B2 11/2001 Moore
6,313,038 B1 11/2001 Chopra et al.
6,319,420 B1 11/2001 Dow
6,323,046 B1 11/2001 Agarwal
6,325,702 B2 12/2001 Robinson
6,328,632 B1 12/2001 Chopra
6,331,135 B1 12/2001 Sabde et al.
6,331,139 B2 12/2001 Walker et al.
6,331,488 B1 12/2001 Doan et al.
6,338,667 B2 1/2002 Sandhu et al.
6,350,180 B2 2/2002 Southwick
6,350,691 B1 2/2002 Lankford
6,352,466 B1 3/2002 Moore
6,352,470 B2 3/2002 Elledge
6,362,105 B1 3/2002 Moore
6,364,746 B2 4/2002 Moore
6,395,130 B1 5/2002 Adams et al.
6,425,801 B1 7/2002 Takeishi et al.
6,428,386 B1 8/2002 Bartlett
6,447,369 B1 9/2002 Moore
6,524,164 B1 2/2003 Tolles
6,537,133 B1 3/2003 Birang et al.
6,537,144 B1 3/2003 Tsai et al.
6,609,947 B1 8/2003 Moore
6,612,901 B1 9/2003 Agarwal
6,628,410 B2 9/2003 Doan

* cited by examiner

PLANARIZING MACHINES AND CONTROL SYSTEMS FOR MECHANICAL AND/OR CHEMICAL-MECHANICAL PLANARIZATION OF MICROELECTRONIC SUBSTRATES

This application is a divisional application of U.S. patent application Ser. No. 09/651,240 entitled "PLANARIZING MACHINES AND CONTROL SYSTEMS FOR MECHANICAL AND/OR CHEMICAL-MECHANICAL PLANARIZATION OF MICROELECTRONIC SUBSTRATES," filed on Aug. 30, 2000, now U.S. Pat. No. 6,609,947, issued Aug. 26, 2003, which is hereby incorporated by reference in its entirety.

TECHNICAL FIELD

The present invention is directed toward mechanical and/or chemical-mechanical planarization of microelectronic substrates. More specifically, the invention is related to planarizing machines and to control systems for monitoring and controlling the status of a microelectronic substrate during a planarizing cycle.

BACKGROUND

Mechanical and chemical-mechanical planarizing processes (collectively "CMP") remove material from the surface of semiconductor wafers, field emission displays or other microelectronic substrates in the production of microelectronic devices and other products. FIG. 1 schematically illustrates a rotary CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a substrate 12 may be attached, or the substrate 12 may be attached to a resilient pad 34 positioned between the substrate 12 and the head 32. The head 32 may be a free-floating wafer carrier, or the head 32 may be coupled to an actuator assembly 36 that imparts axial and/or rotational motion to the substrate 12 (indicated by arrows H and I, respectively).

The planarizing pad 40 and the planarizing solution 44 define a planarizing medium that mechanically and/or chemically-mechanically removes material from the surface of the substrate 12. The planarizing pad 40 can be a fixed-abrasive planarizing pad in which abrasive particles are fixedly bonded to a suspension material. In fixed-abrasive applications, the planarizing solution is typically a non-abrasive "clean solution" without abrasive particles. In other applications, the planarizing pad 40 can be a non-abrasive pad composed of a polymeric material (e.g., polyurethane), resin, felt or other suitable non-abrasive materials. The planarizing solutions 44 used with the non-abrasive planarizing pads are typically abrasive slurries that have abrasive particles suspended in a liquid.

To planarize the substrate 12 with the CMP machine 10, the carrier assembly 30 presses the substrate 12 face-downward against the polishing medium. More specifically, the carrier assembly 30 generally presses the substrate 12 against the planarizing liquid 44 on the planarizing surface 42 of the planarizing pad 40, and the platen 20 and/or the carrier assembly 30 move to rub the substrate 12 against the planarizing surface 42. As the substrate 12 rubs against the planarizing surface 42, material is removed from the face of the substrate 12.

CMP processes should consistently and accurately produce a uniformly planar surface on the substrate to enable precise fabrication of circuits and photo-patterns. During the construction of transistors, contacts, interconnects and other features, many substrates develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a substrate.

In the highly competitive semiconductor industry, it is also desirable to maximize the throughput of CMP processing by producing a planar surface on a substrate as quickly as possible. The throughput of CMP processing is a function, at least in part, of the ability to accurately stop CMP processing at a desired endpoint. In a typical CMP process, the desired endpoint is reached when the surface of the substrate is planar and/or when enough material has been removed from the substrate to form discrete components on the substrate (e.g., shallow trench isolation areas, contacts and damascene lines). Accurately stopping CMP processing at a desired endpoint is important for maintaining a high throughput because the substrate assembly may need to be re-polished if it is "under-planarized," or components on the substrate may be destroyed if it is "over-polished." Thus, it is highly desirable to stop CMP processing at the desired endpoint.

In one conventional method for determining the endpoint of CMP processing, the planarizing period of a particular substrate is determined using an estimated polishing rate based upon the polishing rate of identical substrates that were planarized under the same conditions. The estimated planarizing period for a particular substrate, however, may not be accurate because the polishing rate or other variables may change from one substrate to another. Thus, this method may not produce accurate results.

In another method for determining the endpoint of CMP processing, the substrate is removed from the pad and then a measuring device measures a change in thickness of the substrate. Removing the substrate from the pad, however, interrupts the planarizing process and may damage the substrate. Thus, this method generally reduces the throughput of CMP processing.

U.S. Pat. No. 5,433,651 issued to Lustig et al. ("Lustig") discloses an in-situ chemical-mechanical polishing machine for monitoring the polishing process during a planarizing cycle. The polishing machine has a rotatable polishing table including a window embedded in the table. A polishing pad is attached to the table, and the pad has an aperture aligned with the window embedded in the table. The window is positioned at a location over which the workpiece can pass for in-situ viewing of a polishing surface of the workpiece from beneath the polishing table. The planarizing machine also includes a light source and a device for measuring a reflectance signal representative of an in-situ reflectance of the polishing surface of the workpiece. Lustig discloses terminating a planarizing cycle at the interface between two layers based on the different reflectances of the materials. In many CMP applications, however, the desired endpoint is not at an interface between layers of materials. Thus, the system disclosed in Lustig may not provide accurate results in certain CMP applications.

Another optical endpointing system is a component of the Mirra® planarizing machine manufactured by Applied Materials Corporation of California. The Mirra® machine has a rotary platen with an optical emitter/sensor and a planarizing pad with a window over the optical emitter/sensor. The Mirra® machine has a light source that emits a single wavelength band of light.

U.S. Pat. No. 5,865,665 issued to Yueh ("Yueh") discloses yet another optical endpointing system that determines the endpoint in a CMP process by predicting the removal rate using a Kalman filtering algorithm based on input from a plurality of Line Variable Displacement Transducers ("LVDT") attached to the carrier head. The process in Yueh uses measurements of the downforce to update and refine the prediction of the removal rate calculated by the Kalman filter. This downforce, however, varies across the substrate because the pressure exerted against the substrate is a combination of the force applied by the carrier head and the topography of both the pad surface and the substrate. Moreover, many CMP applications intentionally vary the downforce during the planarizing cycle across the entire substrate, or only in discrete areas of the substrate. The method disclosed in Yueh, therefore, may be difficult to apply in some CMP application because it uses the downforce as an output factor for operating the Kalman filter.

SUMMARY

The present invention is directed toward planarizing machines, control systems for planarizing machines, and method for endpointing or otherwise controlling mechanical and/or chemical-mechanical planarization of microelectronic substrates. In one aspect of the invention, a system for controlling a mechanical or chemical-mechanical planarizing machine comprises a light system, a sensor, and a computer. The light system can have a light source comprising at least a first emitter that generates a first light pulse having a first color and a second emitter that generates a second light pulse having a second color different than the first color. The light source is configured to direct the first and second light pulses toward a front surface of a microelectronic substrate in a manner that creates a first return light pulse corresponding to a reflectance of the first light pulse and a second return light pulse corresponding to a reflectance of the second light pulse. The sensor is configured to receive the first return light pulse and the second return light pulse, and the sensor can generate a first measured intensity of the first return light pulse and a second measured intensity of the second return light pulse. The computer is coupled to the sensor, and the computer may also be coupled to the light source.

The computer has a database and a computer readable medium. The database can contain a plurality of sets of reference reflectances in which each set has a first reference component defined by a reflectance intensity of the first light pulse and a second reference component defined by a reflectance intensity of the second light pulse from a selected surface level in a layer of material on the microelectronic substrate. The computer readable medium can contain a computer readable program that causes the computer to control a parameter of the planarizing machine when the first and second measured intensities correspond to the first and second reference components of a selected reference reflectance set.

The control system described above can have several different embodiments. In one particular embodiment, the light source can further include a third emitter that generates a third source light pulse. For example, the light source can have three emitters such that: (a) the first emitter comprises a red LED that generates a red first light pulse having a wavelength of approximately 600 nm to 780 nm and a red first return light pulse; (b) the second emitter comprises a green LED that generates a green second light pulse having a wavelength of approximately 490 nm to 577 nm and a green second return light pulse; and (c) the third emitter comprises a blue LED that generates a blue third light pulse having a wavelength of approximately 450 nm to 490 nm and a blue third return light pulse. The database can accordingly include an endpoint reference reflectance set having a first reference component corresponding to a first endpoint intensity of the red first return light pulse from an endpoint surface, a second endpoint component corresponding to a second endpoint intensity of the green second return light pulse from the endpoint surface, and a third reference component corresponding to a third endpoint intensity of the blue third return light pulse from the endpoint surface. Additionally, the computer readable program can cause the computer to terminate a planarizing cycle when the first, second and third measured intensities correspond to the first, second and third endpoint intensities, respectively.

Additional aspects of the invention are directed toward methods of planarizing a microelectronic device substrate. One such method in accordance with an embodiment of the invention comprises: contacting a face of the substrate with a planarizing surface of a planarizing pad; moving the substrate and/or the planarizing pad to rub the planarizing surface against the face of the substrate; impinging a first light pulse against the face of the substrate at a first time interval, the first light pulse having a first color; directing a second light pulse against the face of the substrate at a second time interval, the second light pulse having a second color; sensing a first intensity of a first return light pulse corresponding to the first light pulse reflecting from the substrate and a second intensity of a second return light pulse corresponding to the second light pulse reflecting from the substrate; and controlling a parameter of the planarizing cycle of the substrate according to the first and second intensities of the first and second return light pulses.

Another aspect of the invention is a microelectronic substrate assembly for use in controlling mechanical and/or chemical-mechanical planarization processes. One such microelectronic substrate assembly in accordance with an embodiment of the invention comprises a substrate, a first layer over the substrate, a second layer over the first layer, and a sacrificial marking layer or endpoint layer. The first layer is composed of a first material having first color, and the first layer is disposed over at least a portion of the substrate. The first layer also has a first surface defining a desired marking elevation for a planarizing cycle. The second layer is composed of a second material disposed over the first layer, and the second layer has a second color different than the first color. The sacrificial layer is composed of a third material having a third color optically distinct from the first and second colors of the first and second materials. The sacrificial layer, for example, can comprise an opaque resist material. The sacrificial layer can also have a distinct color, such as red, black or white, that has a high optical contrast with the first and second colors of the first and second layers.

DETAILED DESCRIPTION OF THE ILLUSTRATED EMBODIMENTS

The present invention is directed toward planarizing machines, control systems for planarizing machines, and methods for controlling mechanical and/or chemical-mechanical planarization of microelectronic substrates. The terms "substrate" and "substrate assembly" include semiconductor wafers, field emission displays, and other substrate-like structures either before or after forming components, interlevel dielectric layers, and other features and conductive elements of the microelectronic devices. Many specific details of the invention are described below with reference to both rotary and web-format planarizing machines. The present invention, however, can also be practiced using other types of planarizing machines. A person skilled in the art will thus understand that the invention may have additional embodiments, or that the invention may be practiced without several of the details described below.

Figure 1:
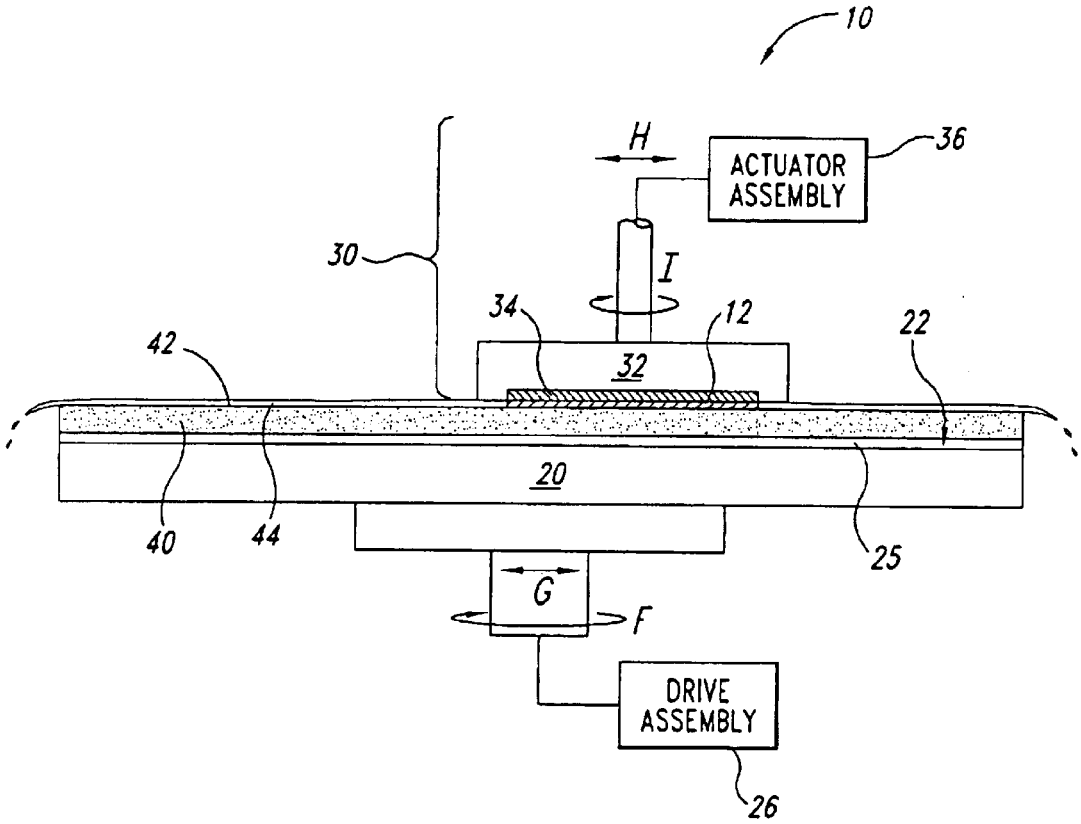
Fig. 1 (Prior Art)
FIG. 1 is cross-sectional view of a rotary-planarizing machine for chemical-mechanical planarization in accordance with the prior art.
Figure 2A:
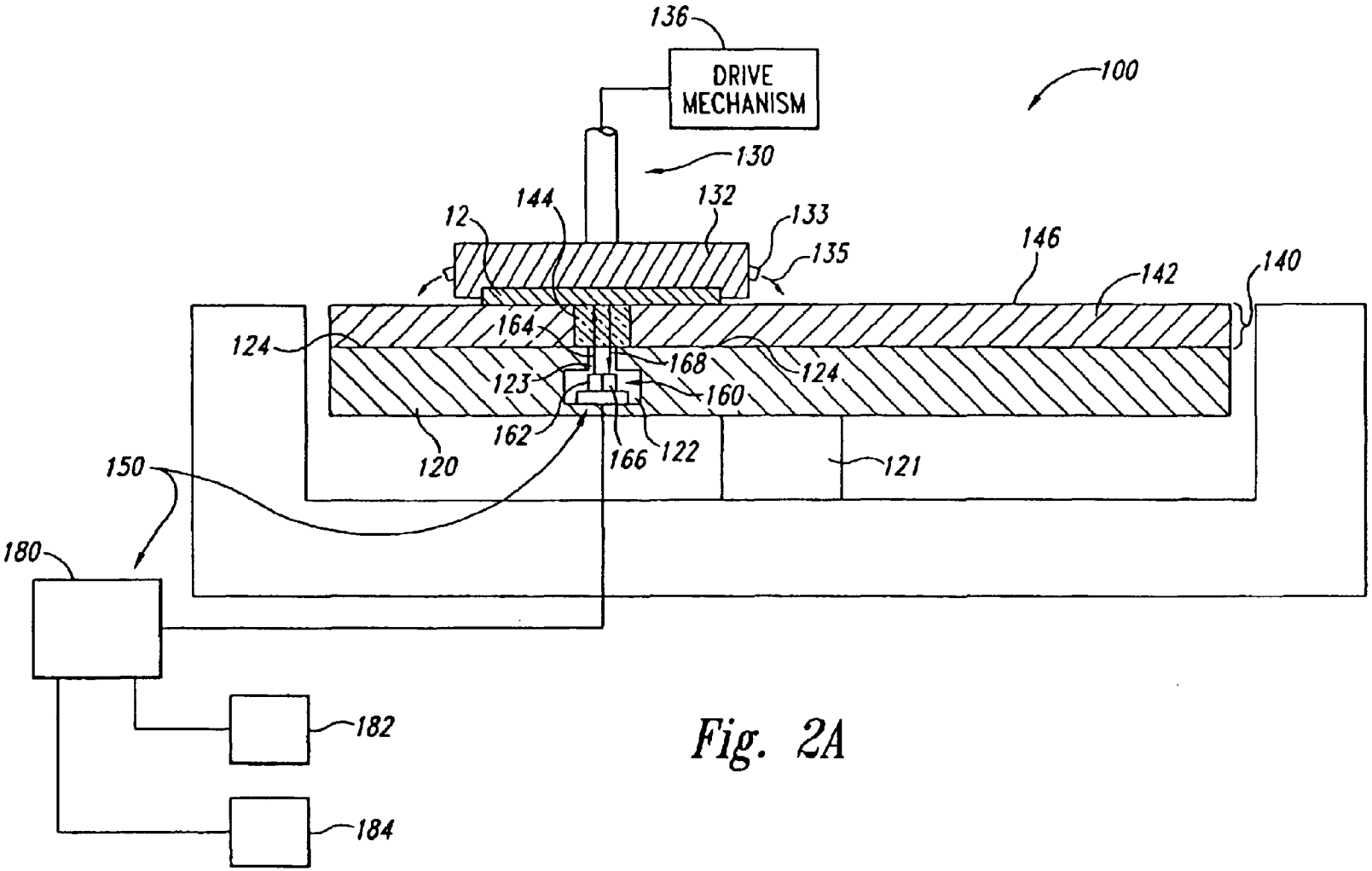
FIG. 2A is cross-sectional view of a rotary planarizing machine having a control system in accordance with an embodiment of the invention.

FIG. 2A is a cross-sectional view of a planarizing machine 100 in accordance with one embodiment of the invention. Several features of the planarizing machine 100 are shown schematically. The planarizing machine 100 of this embodiment includes a table or platen 120 coupled to a drive mechanism 121 that rotates the platen 120. The platen 120 can include a cavity 122 having an opening 123 at a support surface 124. The planarizing machine 100 can also include a carrier assembly 130 having a substrate holder 132 or head coupled to a drive mechanism 136. The substrate holder 132 holds and controls a substrate assembly 12 during a planarizing cycle. The substrate holder 132 can include a plurality of nozzles 133 through which a planarizing solution 135 can flow during a planarizing cycle. The carrier assembly 130 can be substantially the same as the carrier assembly 30 described above with reference to FIG. 1.

The planarizing machine 100 can also include a polishing pad 140 having a planarizing medium 142 and an optically transmissive window 144. The planarizing medium 142 can be an abrasive or non-abrasive body having a planarizing surface 146. For example, an abrasive planarizing medium 142 can have a resin binder and a plurality of abrasive particles fixedly attached to the resin binder. Suitable abrasive planarizing mediums 142 are disclosed in U.S. Pat. Nos. 5,645,471; 5,879,222; and 5,624,303; and U.S. patent application Ser. Nos. 09/164,916 and 09/001,333; all of which are herein incorporated in their entirety by reference. The optically transmissive window 144 can be an insert in the planarizing medium 142. Suitable materials for the optically transmissive window include polyester (e.g., optically transmissive Mylar®); polycarbonate (e.g., Lexan®); fluoropolymers (e.g., Teflon®); glass; or other optically transmissive materials that are also suitable for contacting a surface of a microelectronic substrate 12 during a planarizing cycle. A suitable planarizing pad having an optically transmissive window is disclosed in U.S. patent application Ser. No. 09/595,797, which is herein incorporated in its entirety by reference.

The planarizing machine 100 also includes a control system 150 having a light system 160 and a computer 180. The light system 160 can include a light source 162 that generates source light pulses 164 and a sensor 166 having a photo detector to receive return light pulses 168. As explained in more detail below, the light source 162 is configured to direct the light pulses 164 through the optically transmissive window 144 in the planarizing pad 140 so that the source light pulses 164 periodically impinge a front surface of the microelectronic substrate assembly 12 during a planarizing cycle. The light source 162 can generate a series of light pulses at different wavelengths such that the source light pulses 164 have different colors at different pulses. The sensor 166 is configured to receive the return light pulses 168 that reflect from the front surface of the substrate assembly 12.

The computer 180 is coupled to the light system 160 to activate the light source 162 and/or to receive a signal from the sensor 166 corresponding to the intensities of the return light pulses 168. The computer 180 has a database 182 containing a plurality of sets of reference reflectances corresponding to the status of a layer of material on the planarized face of the substrate 12. The computer 180 also contains a computer-readable program 184 that causes the computer 180 to control a parameter of the planarizing machine 100 when the measured intensities of the return light pulses 168 correspond to a selected set of the reference reflectances in the database 182.

Figure 2B:
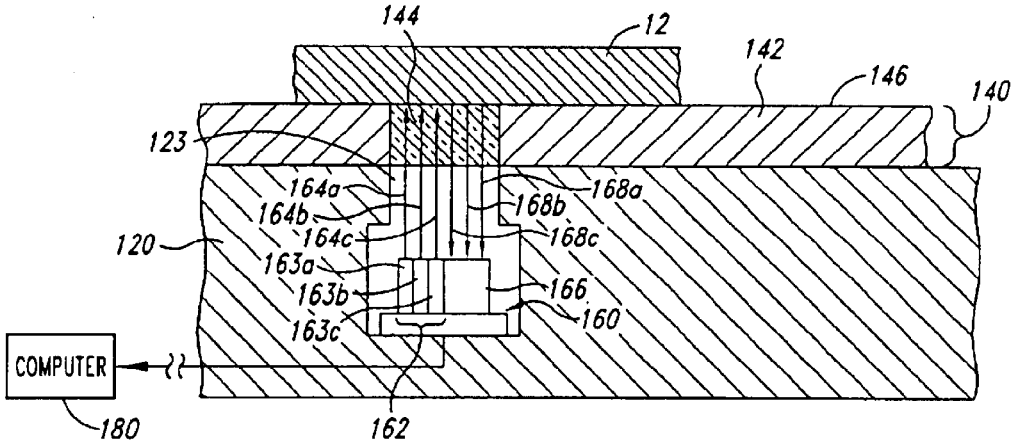
FIG. 2B is a detailed cross-sectional view of a portion of the planarizing machine of FIG. 2A.

FIG. 2B is a partial cross-sectional view illustrating one embodiment of the light system 160 in greater detail. The light system 160 of this embodiment can have a light source 162 including a first emitter 163*a*, a second emitter 163*b*, and a third emitter 163*c*. The first emitter 163*a* emits a first light pulse 164*a* having a first chromatic wavelength defining a first color, the second emitter 163*b* emits a second light pulse 164*b* having a second chromatic wavelength defining a second color, and the third emitter 163*c* emits a third light pulse 164*c* having a third chromatic wavelength defining a third color. The first-third light pulses 164*a–c* are generally discrete pulses such that the first emitter 163*a* emits a discrete first light pulse 164*a*, then the second emitter 163*b* emits a discrete second light pulse 164*b*, and then the third emitter 163*c* emits a discrete third light pulse 164*c*. The colors of the source light pulses 164*a–c* preferably correspond to individual colors of the visual spectrum. For example, the first light pulse 164*a* can be red having a wavelength of 600–780 nm, the second light pulse 164*b* can be green having a wavelength of 490–577 nm, and the third light pulse 164*c* can be blue having a wavelength of 450–490 nm. The first emitter 163*a* can be a red LED, the second emitter 163*b* can be a green LED, and the third emitter 163*c* can be a blue LED. The sensor 166 accordingly has one or more photocells capable of distinguishing the individual intensity of the return light pulses 168*a–c*. The sensor 166 can have only a single photocell that measures the discrete pulses of each of the RGB light pulses. Suitable light systems 160 having pulse operated RGB emitters and a single sensor are manufactured by Keyence Company. In alternative embodiments, the light source 162 can have one or more emitters that emit radiation at discrete bandwidths in the infrared spectrum, ultraviolet spectrum, and/or other radiation spectrums. The term "light," therefore, is not limited to the visual spectrum for the purposes of the present disclosure and claims. The emitters can also emit discrete bandwidths of light/radiation in a combination of spectrums from infrared to spectrums having shorter wavelengths.

In the operation of the light system 160 illustrated in FIG. 2B, the light source 162 preferably activates the first-third emitters 163*a–c* serially as the microelectronic substrate 12 passes over the window 144. The first light pulse 164*a* generated by the first emitter 163*a* passes through the window 144 and reflects from the microelectronic substrate 12 to create the first return light pulse 168*a*. After the first emitter 163*a* generates the first light pulse 164*a*, the second emitter 163*b* generates the second light pulse 164*b*, which reflects from the microelectronic substrate 12 to create the second return light pulse 168*b*. After the second emitter 163*b* generates the second light pulse 164*b*, the third emitter 163*c* generates the third light pulse 164*c*, which reflects from the microelectronic substrate 12 to create the third return light pulse 168*c*. The measured intensities of the return light pulses 168*a–c* can be stored in the computer 180. The light source 162 can activate the emitters 163*a–c* at a period of a few microseconds so that several hundred individual sets of RGB pulse measurements can be obtained as the microelectronic substrate 12 passes over the window 144. The light source 162 can also activate the emitters 163*a–c* in different patterns or at the same time, and the light source 162 can also be controlled by the computer 180 to correlate the source light pulses 164*a–c* with corresponding return light pulses 168*a–c* over time.

The sensor 166 measures the individual intensities of the return light pulses 168*a–c*. The sensor 166 generates a set of intensity measurements for each set of source light pulses 164*a–c* generated by the light source 162. The sensor 166, for example, can generate sets of intensity measurements in which each set has a first measured intensity corresponding to the first return light pulse 168, a second measured intensity corresponding to the second return light pulse 168*b*, and a third measured intensity corresponding to the third return light pulse 168*c*. Each set of intensity measurements corresponds to a set of source light pulses 164*a–c* at a time interval. The intensity measurements can be absolute values expressed as a percentage of the original intensities emitted from the emitters, and the set of intensity measurements can be the absolute values and/or the ratio of the absolute values to each other. In one particular embodiment, the sets of source light pulses 164*a–c* are sets of Red-Green-Blue (RGB) pulses, and the corresponding sets of measured intensities from the sensor 166 represent the absolute intensities and/or the ratio of the RGB return light pulses 168*a–c*.

The intensity of each of the return light pulses 168*a–c* varies because the color of the front face of the substrate 12 changes throughout the planarizing cycle. A typical substrate 12, for example, has several layers of materials (e.g., silicon dioxide, silicon nitride, aluminum, etc.), and each type of material can have a distinct color that produces a unique reflectance intensity for each of the return light pulses 168*a–c*. The actual color properties of a surface on a wafer are a function of the individual colors of the layers of materials on the wafer, the transparency and refraction properties of the layers, the interfaces between the layers, and the thickness of the layers. As such, if the source light pulses 164*a–c* are red, green and blue, respectively, and the surface of the microelectronic substrate 12 changes from green to blue at an interface between layers of material on the substrate 12, then the intensity of the green second return light pulse 168*b* corresponding to the green second light pulse 164*a* will decrease and the intensity of the blue third return light pulse 168*c* corresponding to the blue third light pulse 164*c* will increase.

The computer 180 processes the intensity measurements from the sensor 166 to control a parameter of planarizing the microelectronic substrate 12. In one embodiment, the database 182 contains a plurality of sets of reference reflectances that each have a red reference component, a green reference component, and a blue reference component. Each set of reference reflectances can be determined by measuring the individual intensity of a red return light pulse, a green return light pulse and a blue return light pulse from a particular surface on a layer of material on a test substrate identical to the microelectronic substrate 12. For example, a set of reference reflectances for determining the thickness of a particular layer of material on the microelectronic substrate 12 can be determined by planarizing a test substrate to an intermediate level, measuring the reflectance intensity of each RGB source light pulse, and then using an interferometer or other technique to measure the actual thickness of the layer corresponding to the particular set of RGB measurements. The same type of data can be determined to assess the interface between one layer of material and another on the microelectronic substrate 12. The database 182 can accordingly contain sets of reference reflectances that have reference components corresponding to the actual reflectance intensities of a set of return light pulses at various thicknesses in a layer or at an interface between two layers on the microelectronic substrate 12.

The computer program 184 can be contained on a computer-readable medium stored in the computer 180. In one embodiment, the computer-readable program 184 causes the computer 180 to control a parameter of the planarizing machine 100 when a set of the measured intensities of the return light pulses 168*a–c* are approximately the same as the reference components in a set of reference reflectances stored in the database 182 at a known elevation in the substrate. The set reference reflectances can correspond to a specific elevation in a layer of material, an interface between two layers of material, or another part of the microelectronic substrate. The computer 180, therefore, can indicate that the planarizing cycle is at an endpoint, the wafer has become planar, the polishing rate has changed, and/or control another aspect of planarizing of the microelectronic substrate 12.

The computer 180 can be one type of controller for controlling the planarizing cycle using the control system 150. The controller can alternatively be an analog system having analog circuitry and a set point corresponding to reference reflectances of a specific elevation in a layer of material on the wafer. Additionally, the computer 180 or another type of controller may not terminate or otherwise change an aspect of the planarizing cycle at the first occurrence of the set of reference reflectances. For example, a wafer may have several reoccurrences of a type of layer in a film stack, and the endpoint or other aspect of the planarizing cycle may not occur at the first occurrence of a layer that procedures reflectances corresponding to the set of reference reflectances. The controller can accordingly be set to indicate when a measured set of reflectances matches a particular occurrence of the set of reference reflectances.

Figure 3A:
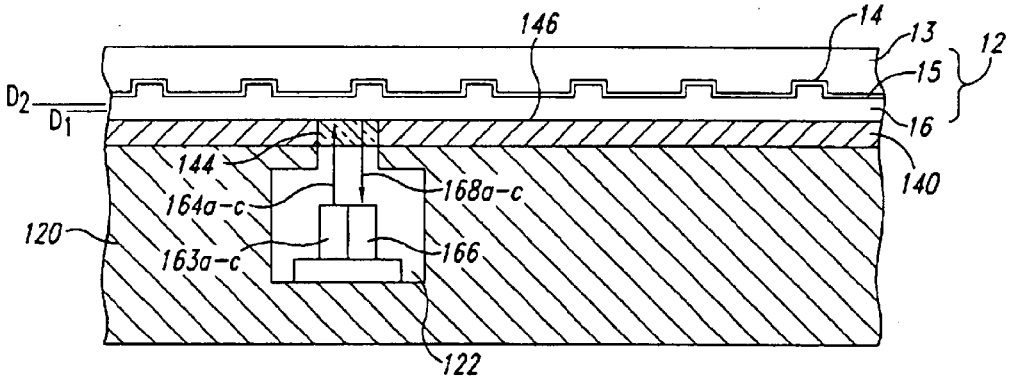
FIG. 3A is a partial cross-sectional view of a planarizing machine illustrating a stage of planarization a microelectronic substrate in accordance with an embodiment of a method in accordance with the invention.
Figure 3B:
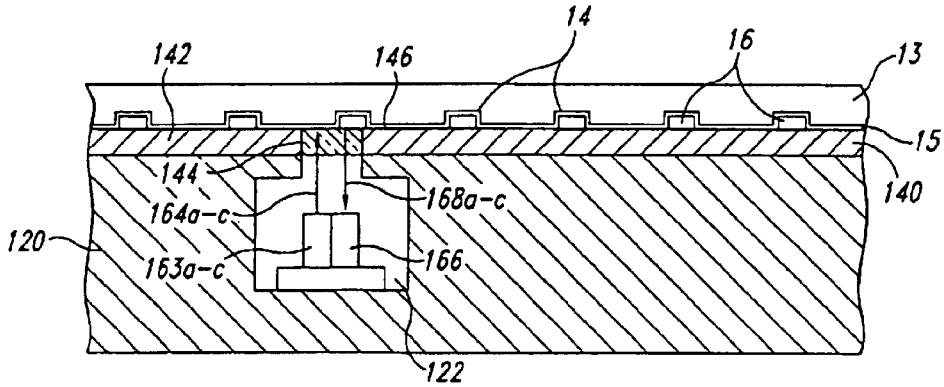
FIG. 3B is a partial cross-sectional view of another stage of planarizing the microelectronic substrate shown in FIG. 3A.

FIGS. 3A and 3B are partial schematic cross-sectional views of stages of a planarizing cycle that use the planarizing machine 100 to form Shallow-Trench-Isolation (STI) structures in an embodiment of a method in accordance with the invention. In this embodiment, the microelectronic substrate assembly 12 has a substrate 13 with a plurality of trenches 14, a silicon nitride ($Si_3N_4$) liner 15 deposited on the substrate 13, and a silicon dioxide ($SiO_2$) layer 16 deposited on the silicon nitride liner 15. The silicon dioxide layer 16 is a semi-transparent green layer, and the silicon nitride liner 15 is a semi-transparent blue/purple layer. Referring to FIG. 3A, the microelectronic substrate assembly 12 is shown at a stage of the planarizing cycle in which the silicon dioxide layer 16 has been partially planarized. Because the silicon dioxide layer is green and the silicon nitride liner 15 is blue/purple, the intensities of the individual red-green-blue return light pulses 168*a–c* will vary as the green silicon dioxide layer 16 becomes thinner. In general, the set of reference reflectances corresponding to the depth $D_1$ in the silicon dioxide layer 16 will have RGB components unique to the depth $D_1$, and the set of reference reflectances corresponding to the depth $D_2$ in the silicon dioxide layer 16 will have RGB components unique to the depth of $D_2$. The RGB components for the silicon dioxide layer 16 at the second depth $D_2$ will generally have a higher blue intensity and a lower green intensity than the RGB components for the depth $D_1$. Referring to FIG. 3B, as the top surface of the silicon nitride liner 15 becomes exposed to the planarizing surface 146 of the polishing pad 140, the RGB components of a set of reference reflectances at this stage of the planarizing cycle will have a significantly higher blue intensity and red intensity corresponding to the blue/purple color of the silicon nitride layer. The actual measured intensities of the RGB return light pulses can accordingly be compared to the stored sets of reference reflectances to determine how much material has been removed from the substrate 12.

The computer program 184 can accordingly cause the computer 180 to control a parameter of the planarizing cycle according to the correspondence between the measured constituent colors of the surface of the microelectronic substrate 12 and the sets of reference reflectances stored in the database 182. In one embodiment, the computer program 184 can cause the computer 180 to determine the polishing rate by measuring the time between the measurements of the return light pulses corresponding to the reference colors at the depths $D_1$ and $D_2$. The computer program 184 can also cause the computer 180 to adjust a parameter of the planarizing cycle, such as the downforce, flow rate of the planarizing solution, and/or relative velocity according to the calculated polishing rate. In another embodiment, the computer program 184 can cause the computer 180 to terminate the planarizing cycle when the measured intensities of a set of return light pulses 168*a–c* correspond to the RGB components of a set of reference reflectances for the endpoint of the substrate 12. For example, if the endpoint of the planarizing cycle is at the top of the silicon nitride liner 15, the computer 180 can terminate the planarizing cycle when the sensor 166 detects an RGB measurement corresponding to the reference color of the top of the silicon nitride liner 15. In other embodiments, the computer 180 can indicate that the wafer is not planar when the measured intensities of the sets of return light pulses establishes that different areas of the surface have different colors.

Figure 4A:
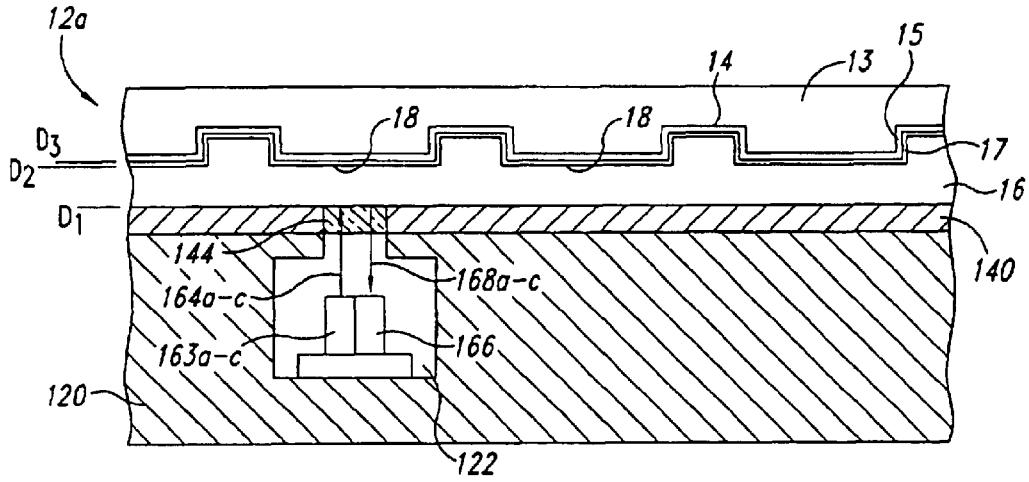
FIG. 4A is a partial schematic cross-sectional view of a microelectronic substrate assemble in accordance with an embodiment of the invention at one stage of a planarizing cycle.

FIG. 4A is a partial schematic cross-sectional view of a planarizing cycle that uses the planarizing machine 100 to form STI structures on a microelectronic substrate assembly 12*a* in accordance with another embodiment of the invention. In this embodiment, the microelectronic substrate assembly 12*a* has a substrate 13 with a plurality of trenches 14, a silicon nitride liner 15 deposited on the substrate 13, and a silicon dioxide layer 16 over the silicon nitride liner 15. The microelectronic substrate assembly 12*a* also includes a sacrificial endpoint layer 17 or marker layer having endpoint indicators 18 at a desired elevation in the substrate assembly 12*a* for endpointing the planarizing cycle. The sacrificial endpoint layer 17 in this particular embodiment is disposed between the silicon nitride liner 15 and the silicon dioxide layer 16 so that the endpoint indicators 18 are on the surface of the silicon nitride liner 15 outside of the trenches 14. The sacrificial endpoint layer 17 can be transparent, semi-transparent, or opaque, and it has a color that has a high-contrast with the colors of the silicon nitride liner 15 and the silicon dioxide layer 16. The sacrificial endpoint layer 17, for example, can be a thin, opaque layer of resist or other material that includes a red pigment that reflects a red source light pulse emitted from the first emitter 163*a*. The sacrificial endpoint layer 17 can also be a layer of black material, white material, or any other color having a suitable contrast. The sacrificial endpoint layer is a marker that can be made from any material that is compatible with the materials and components on the substrate assembly 12. The particular color and transparency of the sacrificial endpoint layer 17 is determined according to the colors and transparencies of the layers immediately above and below the sacrificial layer 17. Accordingly, the sacrificial layer 17 can be used in other types of structures, and it can be sandwiched between other types of materials.

Figure 4B:
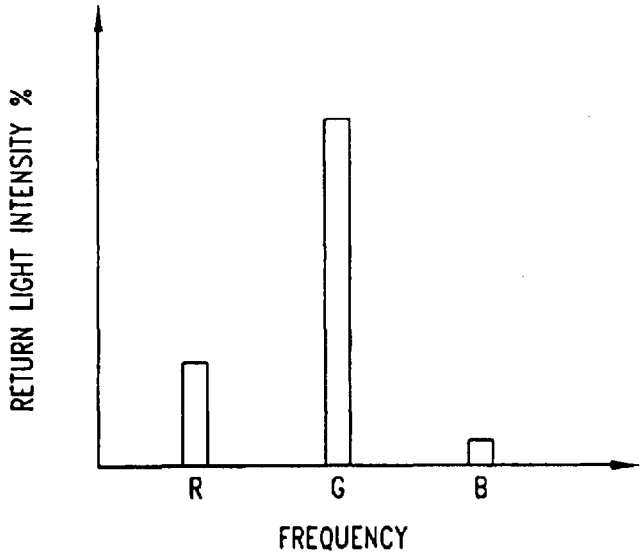
FIG. 4B is a graph illustrating the relative reflectance intensities of red, green and blue return light pulses at the stage of the planarizing cycle shown in FIG. 4A.

FIG. 4B is a graph illustrating a hypothetical set of measured intensities of RGB return light pulses 168*a–c* taken during a planarizing cycle when the surface of the substrate assembly 12*a* is at the depth $D_1$ in the silicon dioxide layer 16. In this particular embodiment, the sacrificial endpoint layer 17 is a substantially red, opaque layer that reflects red light corresponding to the wavelength of the red source light pulses emitted from the first emitter 163*a*. At this point in the planarizing cycle, the red, green and blue source light pulses 164*a–*164*c*, respectively, generate return light pulses 168*a–c* having the relative intensities illustrated in FIG. 4B. The intensity of the red first return light pulse 168*a* corresponding to the red source light pulse 164*a* has an intermediate intensity relative to the green light and the blue light because a portion of the red light passes through the semi-transparent green silicon dioxide layer 16 and reflects from the red sacrificial endpoint layer 17. The intensity of the green second return light pulse 168*b* corresponding to the green source light pulse 164*b* has the highest relative intensity because the semi-transparent green silicon dioxide layer 16 reflects a significant portion of this light pulse. The intensity of the blue third return light pulse 168*c* corresponding to the blue source light pulse 164*c*, however, has the lowest relative intensity because the sacrificial endpoint layer 17 blocks most of the blue light from reflecting from the blue/purple silicon nitride liner 15.

Figure 5A:
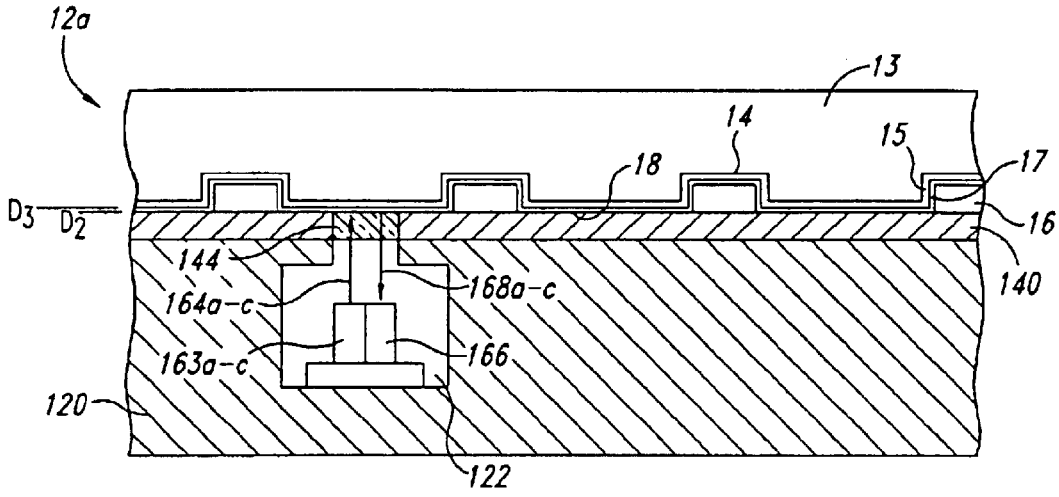
FIG. 5A is a partial schematic cross-sectional view of the microelectronic substrate assembly of FIG. 4A at a subsequent stage of the planarizing cycle.
Figure 5B:
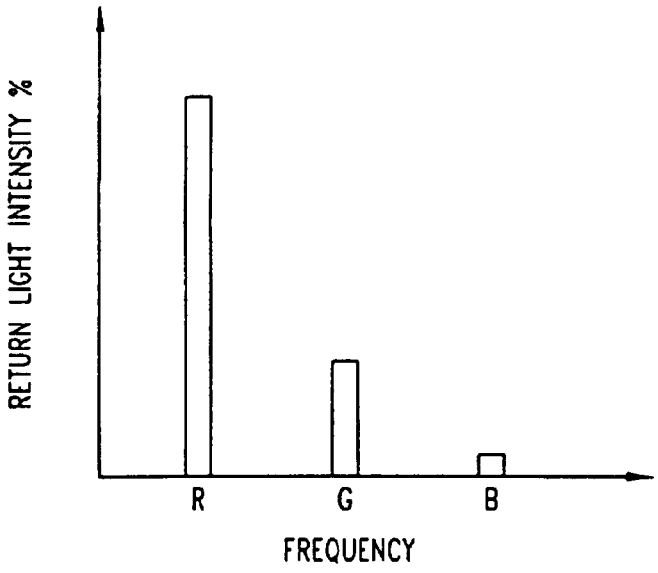
FIG. 5B is a graph illustrating the relative reflectance intensities of red, green and blue return light pulses at the stage of the planarizing cycle shown in FIG. 5A.

FIG. 5A is a partial schematic cross-sectional view of a subsequent stage of planarizing the microelectronic substrate assembly 12*a*, and FIG. 5B is a graph of the intensities of the return light pulses 168*a–c*. At this stage, the bulk of the silicon dioxide layer 16 has been removed to expose the endpoint indicators 18 of the sacrificial endpoint layer 17. Referring to FIG. 5B, the intensity of the first return light pulse 168*a* corresponding to the red source light pulse 164*a* increases significantly corresponding to the higher reflectance of the red light from the red input indicators 18. Conversely, the intensity of the green return light pulse 168*b* decreases significantly corresponding to the reduced thickness of the semi-transparent green silicon dioxide layer 16. The reflectance of the blue return light pulse 168*c* is expected to remain substantially constant in this example because the sacrificial endpoint layer 17 is substantially opaque. The significant increase of the red return light pulse 168*a* and the corresponding decrease of the green return light pulse 168*b* indicates that the planarizing cycle has progressed to the point where the bulk of the silicon dioxide layer 16 has been removed to form isolated areas of silicon dioxide in the trenches 14.

Figure 6A:
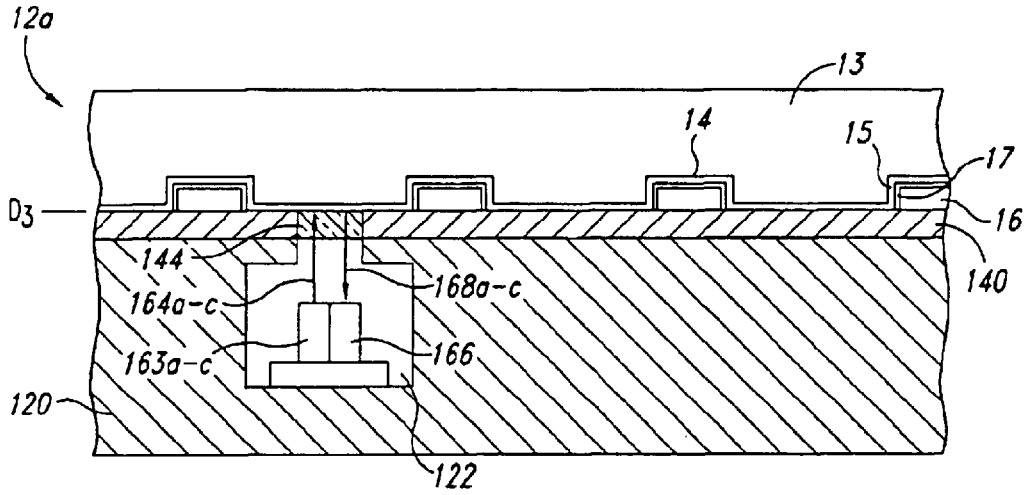
FIG. 6A is a partial schematic cross-sectional view of the microelectronic substrate assembly of FIG. 4A at an endpoint stage of the planarizing cycle.
Figure 6B:
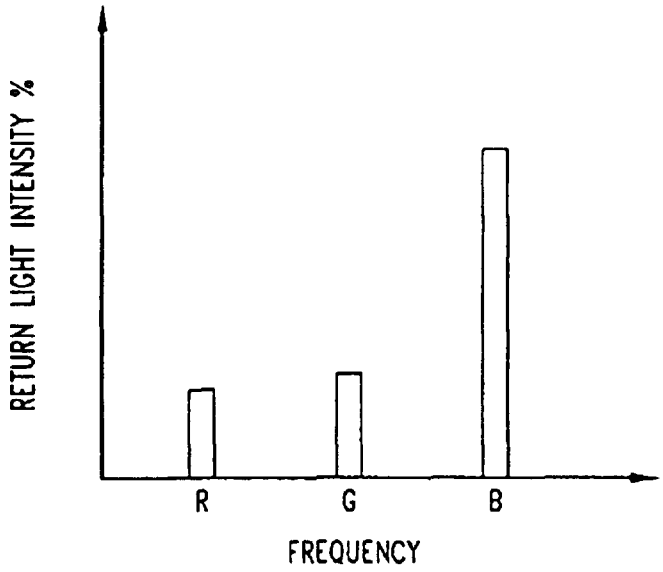
FIG. 6B is a graph illustrating the relative reflectance intensities of red, green and blue return light pulses at the endpoint stage of the planarizing cycle shown in FIG. 6A.

FIG. 6A is a partial cross-sectional view of an endpoint stage of the planarizing cycle for the microelectronic substrate assembly 12*a*, and FIG. 6B is a graph of the intensities of the return light pulses 168*a–c* at this stage of the planarizing cycle. FIG. 6A illustrates the substrate assembly 12*a* after the endpoint indicators 18 have been removed and the surface of the substrate assembly 12*a* is at the depth $D_3$. At this point in the planarizing cycle, the top portions of the silicon nitride liner 15 are exposed to the planarizing pad 140. The substrate assembly 12*a* accordingly has a predominantly blue/purple color corresponding to the silicon nitride liner 15 with microscopic regions of the semi-transparent green silicon dioxide layer 16 in the trenches 14. FIG. 6B illustrates the relative intensities of the return light pulses 168*a–c* from the surface of the substrate assembly 12*a* shown in FIG. 6A. Compared to FIG. 5B, the intensity of the red return light pulse 168*a* drops significantly because the red endpoint indicators 18 (FIG. 5B) have been removed from the substrate assembly 12*a*. Additionally, because the endpoint indicators 18 have been removed to expose the blue/purple silicon nitride liner 15, the intensity of the blue return light pulse 168*c* increases significantly to indicate that the surface of the substrate assembly 12*a* is at the depth $D_3$.

The embodiments of the planarizing machine 100 described above with reference to FIGS. 2A–6B are expected to enhance the ability of endpointing CMP planarizing cycles compared to conventional endpointing techniques that use a single monochromatic or white light to monitor the status of the planarizing cycle. Conventional techniques that use white light or a monochromatic light for the light source are subject to a significant amount of noise that may obfuscate a change in the color of the surface of the substrate assembly. In contrast to such conventional systems, several embodiments of the planarizing machine 100 reduce the noise by generating discrete pulses of light at a plurality of different bandwidths and measuring the intensities of return light pulses with a single sensor. By using a series of pulses of light at different, discrete frequencies, the intensity of the reflectance at other frequencies is inherently filtered. As such, when the surface of the substrate assembly changes from one color to another during a planarizing cycle, the resolution in the change in the intensity of the relative reflectances of the return light pulses is expected to be sufficient to accurately identify the endpoint of the planarizing cycle.

In addition to the advantages of increasing the resolution of the endpoint detection by using discrete pulses of light at discrete frequencies, several embodiments of the planarizing machine 100 are also less complex than conventional planarizing machines that use a monochromatic light or white light. The commercially available planarizing machines that use a monochromatic or white light source typically measure the intensity of the reflectance of the light with a plurality of sensors that each measures the intensity of a discrete wavelength. For example, a typical sensor system for measuring the intensity of the reflectance of white light can have several hundred sensors that measure the intensity of the reflected light for a very small bandwidth to provide the intensity of the reflectance along the full visual spectrum. Such systems are inherently complex because they have such a large number of sensors or sensor elements, and the computer and data management system must accordingly process a large number of measurements for each measurement cycle. In contrast to conventional systems, several embodiments of the planarizing machine 100 use only two or three LED light emitters and a single sensor that measures the intensity of the return light pulses. Therefore, several embodiments of the planarizing machine 100 are expected to be less costly to manufacture and operate, and the planarizing machine 100 can process the data much faster than conventional systems because the planarizing machines can use only a single sensor instead of several hundred sensor elements.

The planarizing machine 100 is also particularly useful in conjunction with a substrate assembly that includes a sacrificial optical endpoint layer. For example, the planarizing machine 100 and the embodiments of the substrate assembly 12*a* described above with reference to FIGS. 4A–6B are expected to provide very accurate endpoint signals. By providing a sacrificial optical endpoint layer 17, the ability to endpoint the planarizing cycle is not compromised by the particular materials that are necessary for fabricating the components on the substrate assembly. The sacrificial optical endpoint layer accordingly provides a marker that is compatible with the materials on the substrate assembly and provides the optical properties that produce a distinctive change in the intensity of the return light pulses at the desired endpoint of the planarizing cycle. Therefore, the embodiments of the substrate assembly 12*a* are expected to enhance the ability to accurately endpoint CMP planarizing cycles using the embodiments of the planarizing machine 100 describe above and other types of optical endpoint techniques for endpointing CMP planarization.

Figure 7:
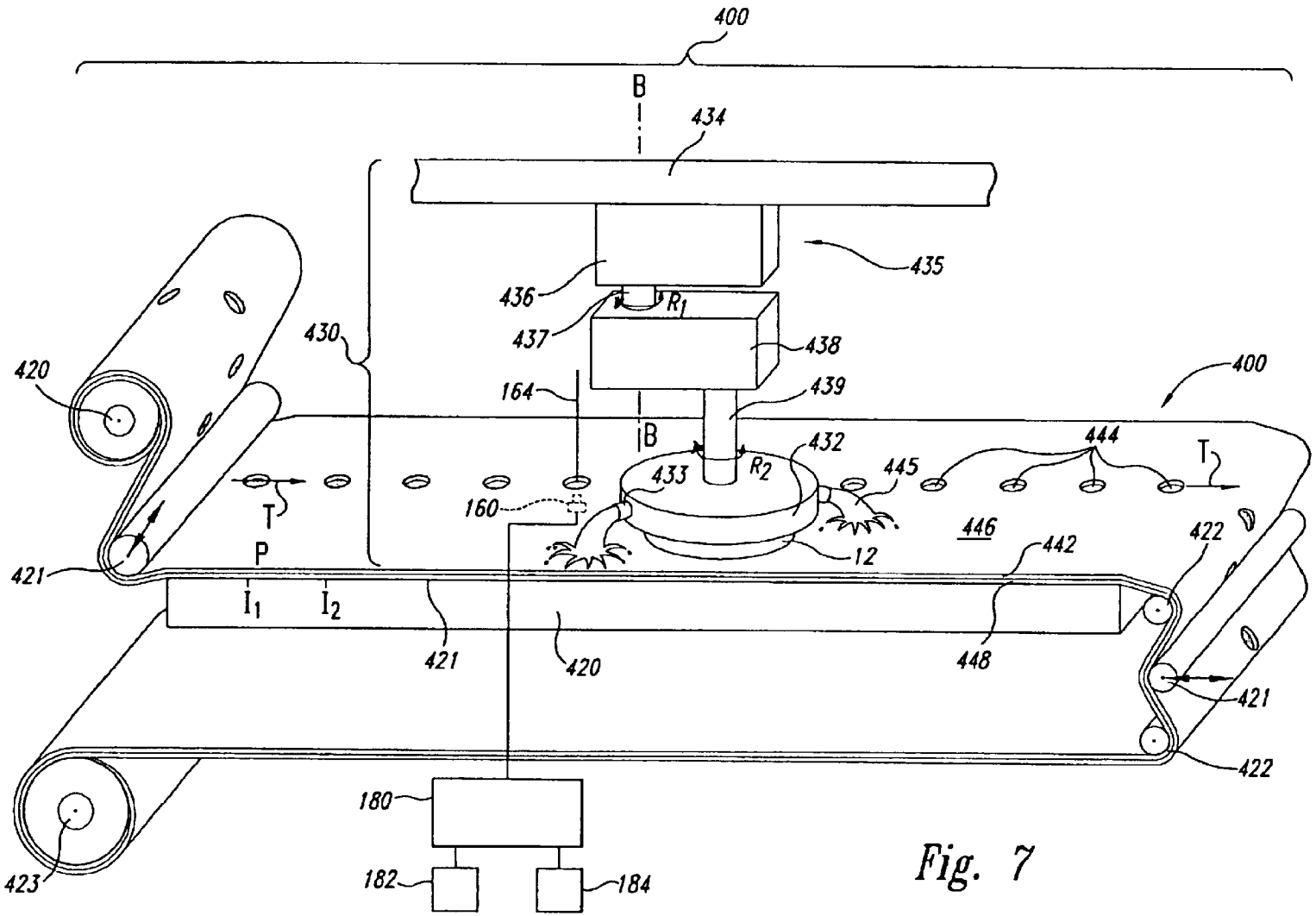
FIG. 7 is an isometric view of a web-format planarizing machine in accordance with an embodiment of the invention.

FIG. 7 is a schematic isometric view of web-format planarizing machine 400 in accordance with another embodiment of invention. The planarizing machine 400 has a support table 420 having a top panel 421 at a workstation where an operative portion of a web-format planarizing pad 440 is positioned. The top panel 421 is generally a rigid plate, and it provides a flat, solid surface to which a particular section of a web-format planarizing pad 440 may be secured during planarization.

The planarization machine 400 also has a plurality of rollers to guide, position, and hold the planarizing pad 440 over the top panel 421. The rollers can include a supply roller 420, idler rollers 421, guide rollers 422, and a take-up roller 423. The supply roller 420 carries an unused or pre-operative portion of the planarizing pad 440, and the take-up roller 423 carries a used or post-operative portion of the planarizing pad 440. Additionally, the left idler roller 421 and the upper guide roller 422 stretch the planarizing pad 440 over the top panel 421 to couple the planarizing pad 440 to the table 420. A motor (not shown) generally drives the take-up roller 423 to sequentially advance the planarizing pad 440 across the top panel 421 along a pad travel path T—T, and the motor can also drive the supply roller 420. Accordingly, a clean pre-operative section of the planarizing pad 440 may be quickly substituted for a used section to provide a consistent surface for planarizing and/or cleaning the substrate 12.

The web-format planarizing machine 400 also includes a carrier assembly 430 that controls and protects the substrate 12 during planarization. The carrier assembly 430 generally has a substrate holder 432 to pick up, hold and release the substrate 12 at appropriate stages of a planarizing cycle. A plurality of nozzles 433 project from the substrate holder 432 to dispense a planarizing solution 445 onto the planarizing pad 440. The carrier assembly 430 also generally has a support gantry 434 carrying a drive assembly 435 that can translate along the gantry 434. The drive assembly 435 generally has an actuator 436, a drive shaft 437 coupled to the actuator 436, and an arm 438 projecting from the drive shaft 437. The arm 438 carries a substrate holder 432 via a terminal shaft 439 such that the drive assembly 435 orbits substrate holder 432 about an axis B—B (arrow $R_1$). The terminal shaft 439 may also be coupled to the actuator 436 to rotate the substrate holder 432 about its central axis C—C (arrow $R_2$).

The planarizing pad 440 shown in FIG. 7 can include a planarizing medium 442 having a plurality of optically transmissive windows 444 arranged in a line generally parallel to the pad travel path T—T. The planarizing pad 440 can also include an optically transmissive backing film 448 under the planarizing medium 442. Suitable planarizing pads for web-format machines are disclosed in U.S. patent application Ser. No. 09/595,727.

The planarizing machine 400 can also include a control system having the light system 160 and the computer 180 described above with reference to FIGS. 2A–6B. In operation, the carrier assembly 430 preferably lowers the substrate 12 against the planarizing medium 442 and orbits the substrate holder 432 about the axis B—B to rub the substrate 12 against the planarizing medium 442. The light system 160 emits the source light pulses 164, which pass through a window 444 aligned with an illumination site on the table 420 to optically monitor the status of the substrate 12 during the planarizing cycle as discussed above with reference to FIGS. 2A–6B. The web-format planarizing machine 400 with the light system 160 and the computer 180 is thus expected to provide the same advantages as the planarizing machine 100 described above.

Figure 8A:
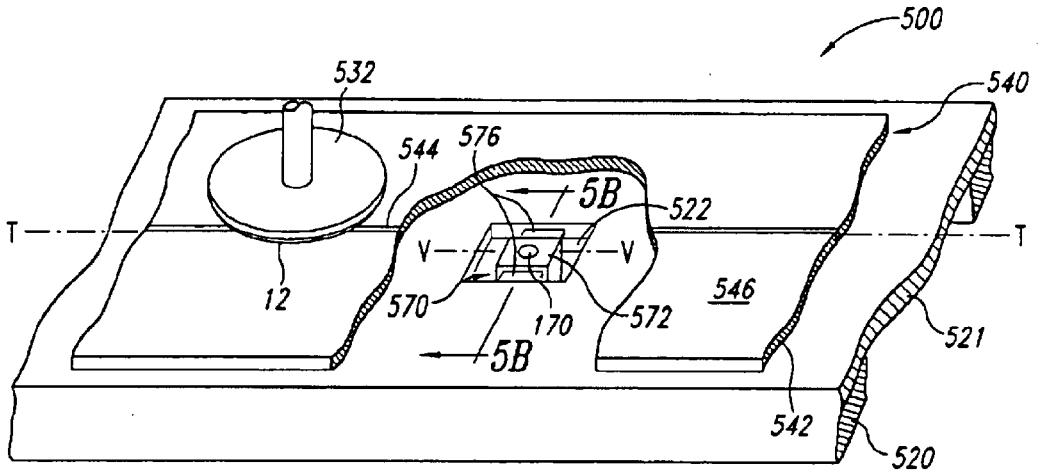
FIG. 8A is a partial isometric view showing a cut-away section of a web-format planarizing machine in accordance with another embodiment of the invention.
Figure 8B:
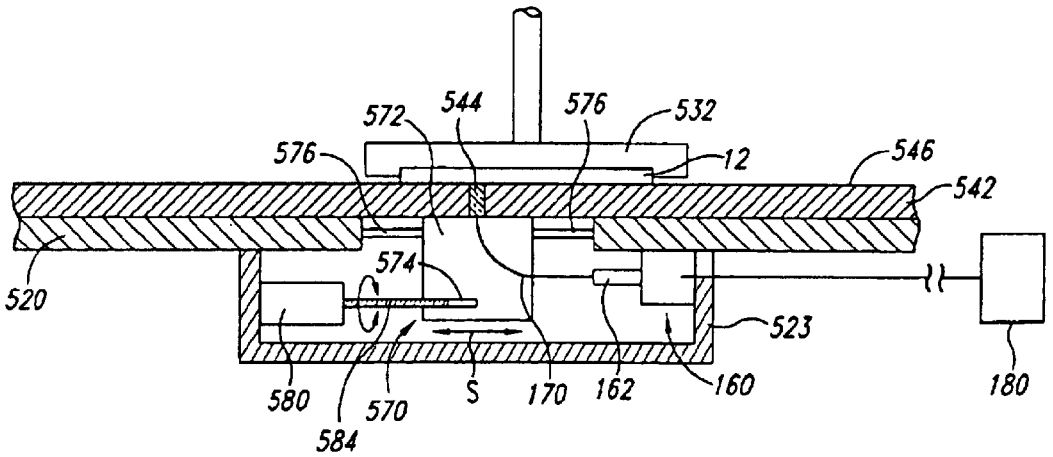
FIG. 8B is a partial cross-sectional view of a portion of the web-format planarizing machine illustrated in FIG. 8A.

FIG. 8A is a partial isometric cut-away view and FIG. 8B is a partial cross-sectional view of a web-format planarizing machine 500 in accordance with another embodiment of invention. The planarizing machine 500 can include a table 520 having a support panel 521 with an opening 522 (FIG. 8A) and a housing 523 (FIG. 8B). The planarizing machine 500 can also include a substrate holder 532 for carrying a substrate 12, and a planarizing pad 540 that can move along the support panel 521 along a pad travel path T—T (FIG. 8B). The substrate holder 532 can be substantially the same as the substrate holder 432 described above. The planarizing pad 540 can have a planarizing medium 542 and a single elongated optically transmissive window 544 extending along the pad travel path T—T. The planarizing pad 540 can accordingly operate in much the same manner as the planarizing pad 440 described above.

The planarizing machine 500 can further include an alignment assembly or alignment jig 570 having a carriage 572 and an actuator 580. The carriage 572 can include a threaded bore 574, and the actuator 580 can have a threaded shaft 584 that is threadedly engaged with the bore 574. The actuator 580 can be a servomotor that rotates the shaft 584 either clockwise or counter clockwise to move the carriage 572 transverse to the pad travel path T—T. The actuator 580 can alternatively be a hydraulic or pneumatic cylinder having a rod connected to the carriage 572. The alignment jig 570 can also include a guide bar 576 that is slideably received through a smooth bore (not shown) in the carriage 572.

The planarizing machine 500 can also include a control system having the light system 160 and the computer 180 coupled to the light system 160. In this embodiment, the light system 160 is attached to the housing 523, and the light system 160 includes an optical transmission medium 170 coupled to the light source 162 and the carriage 572. The transmission medium 170 can be a fiberoptic cable with one or more fiberoptic elements that transmit both the source light pulses 164 and the return light pulses 168. The planarizing machine 500 can alternatively have another type of light system, such as a light system that uses a white light source or a monochromatic light source. As such, the light systems for the planarizing machine 500 are not limited to the light system 160 described above with reference to FIGS. 2A–6B.

Several embodiments of the planarizing machine 500 are expected to enhance the ability to optically endpoint CMP planarizing cycles on web-format planarizing machines. One concern of using web-format planarizing machines is that the planarizing pad 540 can skew transversely to the pad travel path T—T as it moves across the table 520. When this occurs, the window 544 in the planarizing pad 540 may not be aligned with the light source. Several embodiments of the planarizing machine 500 resolve this problem because the transmission medium 170 for the light source 162 can be continuously aligned with the window 544 by moving the carriage 572 in correspondence to the skew of the planarizing pad 540. In one embodiment, the carriage 572 can be controlled manually to align the distal end of the transmission medium 170 with the window 544 in the planarizing pad 540. In another embodiment, the computer 180 can be programmed to control the actuator 580 for automatically moving the carriage 572 when the distal end of the transmission medium 170 is not aligned with the window 544. For example, when the light system 160 detects a significant drop in the intensity of all wavelengths of the return light pulses, the computer 180 can be programmed to move the carriage 572 so that the distal end of the transmission medium 170 scans the backside of the planarizing pad 540 until the intensities of the return light pulses indicate that the distal end of the transmission medium 170 is aligned with the window 544 in the planarizing pad 540. The computer 180 can also indicate the direction of pad skew and provide feedback to a drive control mechanism that operates the rollers. The computer 180 can accordingly manipulate the drive control mechanism to correct pad skew or other movement of the pad that can affect the performance characteristics of the pad. Therefore, several embodiments of the planarizing machine 500 are expected to provide for continuous optical monitoring of the substrate assembly during a planarizing cycle using a web-format planarizing pad.

Several embodiments of the planarizing machine 500 are also expected to reduce defects or scratching caused by planarizing a wafer over planarizing pads with windows. One concern of CMP processing is that wide windows are generally necessary in machines without the alignment jig because the pad skews as it moves along the pad travel path. Such wide windows, however, can scratch or produce defects on wafers. The window 544 in the planarizing pad 540 can be much narrower than other windows because the alignment jig 570 moves with the pad skew. As such, several embodiments of the planarizing machine are also expected to reduce defects and scratching during CMP processes.

Figure 9:
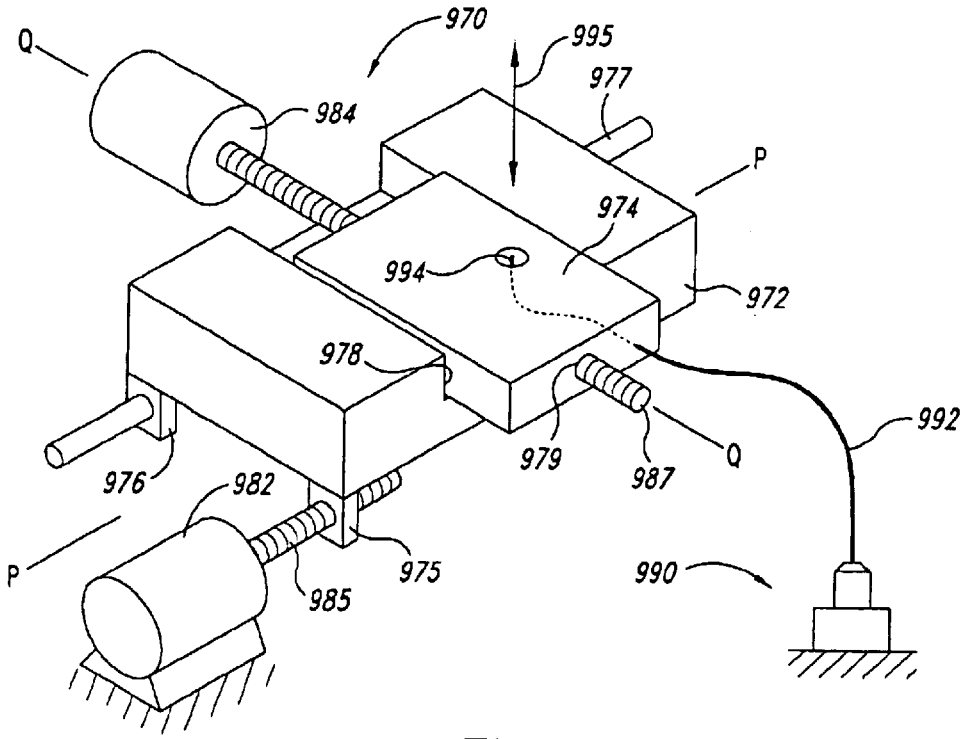
FIG. 9 is an isometric view of an alignment jig for a web-format planarizing machine in accordance with an embodiment of the invention.

FIG. 9 is an isometric view of an alignment assembly or alignment jig 970 for a web-format planarizing machine in accordance with another embodiment of the invention. In this embodiment, the alignment jig 970 can include a first carriage 972 coupled to a first actuator 982 by a threaded rod 985, and a second carriage 974 coupled to a second actuator 984 by a threaded rod 987. The first carriage 972 can threadedly receive the threaded rod 985 and slideably receive a guide bar 977. The first actuator 982 accordingly rotates the threaded rod 985 to move the first carriage 972 along a first axis P—P defining a first alignment path. The second carriage 974 is slidably received in a channel 978 of the first carriage 972. The second carriage 974 has a threaded bore 979 to threadedly receive the threaded rod 987. The second actuator 984 is also attached to the first carriage 972. Thus, the second actuator 972 rotates the threaded rod 987 to move the second carriage 974 along a second axis Q—Q defining a second alignment path that is transverse to the axis P—P. The second actuator 984 accordingly moves the second carriage 974 along the channel 978 in the first carriage 972.

The alignment jig 970 can be coupled to a light system 990 by an optical transmission medium 992 extending between the light system 990 and the second carriage 974 of the alignment jig 970. The light system 990 can be a multi-color system having a plurality of emitters that generate discrete pulses of light at different colors in a manner similar to the optical system 160 described above with reference to FIGS. 2A–6B. The light system 990 can alternatively be a system having a white light source or a monochromatic light source that operates continuously or by generating pulses. In either case, the transmission medium 992 has a distal end 994 configured to emit a source light and receive a return light along a light path 995. The light system 990 can accordingly be affixed to a web-format planarizing machine and the distal end 994 of the optical transmission medium 992 can travel with the alignment jig 970 to align the light path 995 with an optically transmissive window in a planarizing pad. The transmission medium 992 can be a fiber-optic line.

The alignment jig 970 operates by actuating the first actuator 982 and/or the second actuator 984 to position to distal end 994 of the transmission medium 992 at a desired location relative to an optically transmissive window in a planarizing pad and/or a substrate assembly on the planarizing pad. For example, the alignment jig 970 can be used with the planarizing machine 500 described above with reference to FIGS. 8A and 8B by activating the first actuator 982 to move the first carriage 972 along the axis P—P for aligning the light path 995 with the window 544. The axis P—P can accordingly be transverse to the pad travel path T—T (FIG. 8A). Additionally, the light path 995 can be moved to impinge a desired area on the substrate assembly 12 by activating the second actuator 984 to move the second carriage 974 along the axis Q—Q. The axis Q—Q can accordingly be at least substantially parallel to the pad travel path T—T. The first and second actuators 982 and 984 can be activated serially to first move the light path 995 along one axis and then along the other axis, or the first and second actuators 982 and 984 can be activated simultaneously to move the light path 995 along an arcuate course.

Figure 10:
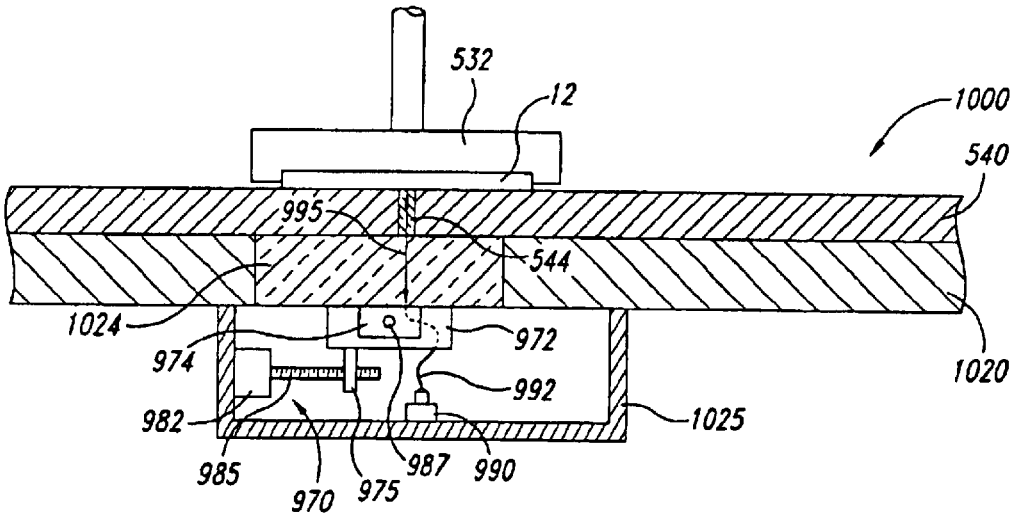
FIG. 10 is a cross-sectional view of a web-format planarizing machine having an alignment jig in accordance with an embodiment of the invention.

FIG. 10 is a partial front cross-sectional view of another web-format planarizing machine 1000 in accordance with another embodiment of the invention. The web-format planarizing machine 1000 can have components that are identical or similar to the components of the planarizing machine 500 and the alignment jig 970 illustrated in FIGS. 8A–9, and thus like reference numbers refer to like components in these figures. The web-format planarizing machine 1000 can accordingly have a substrate 12 in a substrate holder 532 and a planarizing pad 540 having an optically transmissive window 544. The planarizing machine 1000 can also include a table 1020 having an optically transmissive window 1024 and a housing 1025 underneath the window 1024. The alignment jig 970 and the light system 990 can be attached to the housing 1025 so that the distal end 994 of the transmission medium 992 is directed towards the transmissive window 544. In an alternative embodiment, the alignment jig 570 can be substituted for the alignment jig 970 in the web-format planarizing machine 1000. In operation, the alignment jig 970 aligns the distal end 994 of the transmission medium 992 with the optically transmissive window 544 in the planarizing pad so that the source light pulses and the return light pulses can travel along the light path 995 through the optically transmissive windows 1024 and 544.

The embodiment of the planarizing machine 1000 illustrated in FIG. 10 is expected to provide several of the same advantages as the planarizing machine 500 illustrated in FIGS. 8A–8B. The planarizing machine 1000, however, may also provide for a larger area for the alignment jig 970 to position the optical transmission medium 992 because the optical window 1024 in the table 1020 fully supports the planarizing pad 540. Therefore, the alignment jig 970 can move the first and second carriages 972 and 974 relative to the planarizing pad 540 without producing large unsupported areas of the planarizing pad 540 that may cause the planarizing pad 540 to have a non-planar planarizing surface.

From the foregoing, it will be appreciated that specific embodiments of the invention have been described herein for purposes of illustration, but that various modifications may be made without deviating from the spirit and scope of the invention. The light systems 160 and 990 shown in FIGS. 8B and 9, for example, can be mounted directly to the carriages 572 or 974 to eliminate the optical transmission mediums 170 and 992. Accordingly, the invention is not limited except as by the appended claims.

What is claimed is:

1. A microelectronic substrate assembly for use in controlling mechanical and/or chemical-mechanical planarization processes, comprising:

a substrate;

a first layer of a first material having first color, the first layer being disposed over at least a portion of the substrate, and the first layer having a first surface defining a desired endpoint elevation for a planarizing cycle;

a second layer of a second material disposed over the first layer, the second layer having a second color different than the first color; and a sacrificial marker layer of a third material having a third color optically distinct from the first and second colors of the first and second materials.

2.The microelectronic substrate of claim 1 wherein:

the first material comprises silicon nitride;

the second material comprises silicon dioxide; and the third material of the sacrificial marker layer comprises an opaque resist material.

3. The microelectronic substrate of claim 1 wherein:

the first material comprises silicon nitride;

the second material comprises silicon dioxide; and the third material of the sacrificial marker layer comprises an optically transmissive material.

4. The microelectronic substrate of claim 1 wherein:

the first material comprises silicon nitride;

the second material comprises silicon dioxide; and the third material of the sacrificial marker layer comprises a red layer of material.

5. The microelectronic substrate of claim 1 wherein:

the first material comprises silicon nitride;

the second material comprises silicon dioxide; and the third material of the sacrificial marker layer comprises a black layer of material.

6. The microelectronic substrate of claim 1 wherein:

the first material comprises silicon nitride;

the second material comprises silicon dioxide; and the third material of the sacrificial marker layer comprises a white layer of material.

7. A microelectronic substrate assembly for use in controlling mechanical and/or chemical-mechanical planarization processes, comprising:

a substrate;

a first layer of a first material having a first color, the first layer being disposed over at least a portion of the substrate;

a second layer of a second material having a second color, the second layer being disposed relative to the first layer; and a sacrificial marker layer of a third material having a third color optically distinct from the first and second colors of the first and second materials, the sacrificial layer being disposed between the first layer and the second layer.

8. The microelectronic substrate of claim 7 wherein the sacrificial layer is on the first layer and the second layer is on the sacrificial layer.

9. The microelectronic substrate of claim 7 wherein the first layer is silicon nitride, the second layer is silicon dioxide, and the sacrificial layer is an opaque material.

10. The microelectronic substrate of claim 7 wherein the first layer is silicon nitride, the second layer is silicon dioxide, the sacrificial layer is on the first layer, and the second layer is on the sacrificial layer.

11. The microelectronic substrate of claim 7 wherein the first layer comprises silicon nitride, the second layer comprises silicon dioxide, and the third material of the sacrificial layer is red.

12. The microelectronic substrate of claim 7 wherein the first layer comprises silicon nitride, the second layer comprises silicon dioxide, and the third material of the sacrificial layer is black.

13. The microelectronic substrate of claim 7 wherein the first layer comprises silicon nitride, the second layer comprises silicon dioxide, and the third material of the sacrificial layer is white.

14. A method of mechanical and/or chemical-mechanical planarization of a microelectronic workpiece, comprising:

providing a microelectronic workpiece including (a) a substrate, (b) a first layer of a first material having a first color, the first layer being disposed over at least a portion of the substrate, (c) a second layer of a second material having a second color, the second layer being disposed relative to the first layer, and (c) a sacrificial marker layer of a third material having a third color optically distinct from the first and second colors of the first and second materials, the sacrificial layer being disposed between the first layer and the second layer;

contacting a face of the substrate with a planarizing surface of a planarizing pad while moving the substrate and/or the planarizing pad relative to each other;

impinging a series of light pulses against the substrate including a first light pulse at a first time interval and a second light pulse at a second time interval, the first light pulse having a first frequency and the second light pulse having a second frequency;

sensing a first intensity of a first return light pulse corresponding to the first light pulse reflecting from the substrate and a second intensity of a second return light pulse corresponding to the second light pulse reflecting from the substrate; and controlling a parameter of the planarization process when the first and second intensities indicate that the sacrificial layer is exposed and/or at least partially removed from the substrate.

15. The method of claim 14 wherein controlling a parameter of the planarization process comprises indicating the intensity of the second color of the second layer and the intensity of third color of the sacrificial layer.

16. The method of claim 14 wherein controlling a parameter of the planarization process comprises indicating the intensity of the first color of the first layer and the intensity of the third color of the sacrificial layer.

17. The method of claim 14 wherein the sacrificial layer is red and controlling a parameter of the planarization process comprises indicating the intensity of the first color of the first layer, the second color of the second layer, and the third color of the sacrificial layer.

18. The method of claim 17 wherein one of the first light pulse or second light pulse is red, the sacrificial layer is red, and indicating the intensity of the sacrificial layer comprises impinging the first or second pulse of red light against the substrate and sensing the intensity of the return pulse of the red light.

19. The method of claim 17 wherein the sacrificial layer is white and indicating the intensity of the sacrificial layer comprises impinging discreet pulses of red, green and blue light against the substrate and sensing the intensities of return pulses of the red, green and blue light.

20. The method of claim 17 wherein the sacrificial layer is black and indicating the intensity of the sacrificial layer comprises impinging discreet pulses of red, green and blue light against the substrate and sensing the intensities of return pulses of the red, green and blue light.

* * * * *